US005912536A

United States Patent [19]

Michiels et al.

[11] Patent Number: 5,912,536

[45] Date of Patent: Jun. 15, 1999

[54] LIGHTING UNIT AND ELECTRODELESS LOW-PRESSURE DISCHARGE LAMP AND DISCHARGE VESSEL FOR USE IN SAID LIGHTING UNIT

[75] Inventors: Leonardus G. M. Michiels; Petrus F. J. Van Den Boom, both of Eindhoven, Netherlands

[73] Assignee: U.S. Philips Corporation, New York, N.Y.

[21] Appl. No.: 08/653,932

[22] Filed: May 22, 1996

[30] Foreign Application Priority Data

May 24, 1995 [EP] European Pat. Off. ..... 95201372

[51] Int. Cl.[6] ..... H05B 41/24

[52] U.S. Cl. ..... 315/248; 315/344; 313/490; 313/493

[58] Field of Search ..... 313/485, 490, 313/493, 550, 565, 313; 315/248, 344

[56] References Cited

U.S. PATENT DOCUMENTS 4,728,867 3/1988 Postma et al. ..... 315/248

4,940,923 7/1990 Kroontje et al. ..... 315/248

*Primary Examiner*—Arnold Kinkead

*Attorney, Agent, or Firm*—Bernard Franzblau

[57] ABSTRACT

A lighting unit comprises an electrodeless low-pressure discharge lamp (10) and an electric supply (60) for the lamp. The lamp is provided with a discharge vessel (20) having a radiation-transmitting enveloping portion (21) and a recessed portion (24). The discharge vessel encloses a discharge space (27) in a gastight manner and contains an ionizable filling. The lamp also is provided with a coil (30) positioned in the recessed portion for generating a high-frequency magnetic field so as to maintain an electric discharge in the discharge space. The enveloping portion (21) of the discharge vessel is provided with a radiation-transmitting, electrically conducting layer (22) at a surface facing the discharge space (27). This layer is electrically connected to a lead-through member (42) which issues to the exterior of the discharge vessel. The lead-through member is a metal tube which forms at least a portion of a tubular projection (46, 42, 47). The discharge vessel of the lighting unit can be manufactured comparatively easily and can have a comparatively compact construction.

20 Claims, 1 Drawing Sheet

LIGHTING UNIT AND ELECTRODELESS LOW-PRESSURE DISCHARGE LAMP AND DISCHARGE VESSEL FOR USE IN SAID LIGHTING UNIT

BACKGROUND OF THE INVENTION

This invention relates to a lighting unit comprising an electrodeless low-pressure discharge lamp and a supply for said lamp, which lamp is provided with a discharge vessel having a radiation-transmitting enveloping portion and a recessed portion, which discharge vessel surrounds a discharge space in a gastight manner and contains an ionizable filling, the lamp being further provided with a coil arranged in the recessed portion for generating a high-frequency magnetic field so as to maintain an electric discharge in the discharge space, while the enveloping portion of the discharge vessel is provided with a radiation-transmitting, electrically conducting layer on a surface facing the discharge space, the discharge vessel having a tubular projecting portion where a lead-through member connected to the electrically conducting layer issues to the exterior.

The invention further relates to an electrodeless low-pressure discharge lamp and to a discharge vessel for use in the lighting unit.

A lighting unit of the kind described in the opening paragraph, wherein the supply is accommodated in a holder which is fastened to the discharge vessel and which also supports a lamp cap, is known from U.S. Pat. No. 4,940,923. The lamp of the known lighting unit is operated at high frequency, i.e. at a frequency higher than approximately 20 kHz, in that case a frequency of approximately 3 MHz. The discharge vessel of the lamp supports a radiation-transmitting, electrically conducting layer, also called a conducting layer hereinafter, of fluorine-doped tin oxide. A metal wire electrically connected to the conducting layer issues to the exterior through the fused free end of a glass tubular projection of the discharge vessel, thus at the same time forming the lead-through member.

During operation of the lighting unit, the conducting layer is connected to a pole of the power mains via the metal wire, the lead-through member formed thereby, and a contact of the lamp cap. Interferences in the power mains and in the area surrounding the lamp caused by the high-frequency operation of the lamp thus remain limited.

It is comparatively easy during the manufacture of the known lamp to close the glass projection around the lead-through member in a gastight manner, provided cleaning and filling of the discharge vessel take place through a separate channel. Indeed, if the tubular projection is used for this purpose and is subsequently sealed up around the lead-through member, deformations will arise in the molten glass as a result of the pressure difference between the inside and outside of the discharge vessel. These deformations of the glass of the projection adjoining the lead-through member result in inadmissible mechanical stresses which give rise to fractures. The presence of a separate channel, however, renders it difficult to achieve a compact discharge vessel construction.

SUMMARY OF THE INVENTION

It is an object of the invention to provide a lighting unit of the kind described in the opening paragraph whose construction can be comparatively easily realized and which can nevertheless be compact.

According to the invention, the lighting unit of the kind described in the opening paragraph is for this purpose characterized in that the lead-through member is a metal tube which constitutes at least a portion of the tubular projection. Cleaning and filling of the discharge vessel can take place through the metal tube in the lamp according to the invention, after this tube has been fused to the discharge vessel. Mechanical stresses in the glass thus are avoided.

The tube may be fused in the enveloping portion so that it is directly connected to the conducting layer.

In a modification, the tube is connected to the conducting layer via an internal conductor. The tube is, for example, fused to the recessed portion in that case. The electrical connection between the internal conductor and the lead-through member may be realized in that the metal tube is pinched tightly around the internal conductor. Alternatively, the internal conductor has, for example, a resilient end which is accommodated in the tube with a clamping fit, or the internal conductor is fastened to the tube, for example, by (laser) welding. After cleaning and filling, the discharge vessel may be closed in a gastight manner in that the metal tube is closed by pinching, welding, or pinching and welding.

In an embodiment, the metal tube is provided with a glass seal.

In an attractive modification of this embodiment, the glass seal surrounds a space in which an amalgam is accommodated.

The tube may be made from a metal which has a coefficient of expansion which corresponds to that of the glass of the discharge vessel, for example, in the case of lime glass, a CrNiFe alloy, for example Cr 6%, Ni 42%, remainder Fe (by weight). In a hard-glass lamp vessel, for example borosilicate glass, a tube, for example, of Ni/Fe or of NiCoFe may be used, for example Ni 29%, Co 17%, remainder Fe (by weight).

The internal conductor is, for example, wire-shaped or ribbon-shaped and may bear on the conducting layer, for example, resiliently. It is favorable when the radiation-transmitting, electrically conducting layer is connected to the metal tube via a contact member at the internal conductor which is fixed by fusion in the enveloping portion. A very reliable contact with the conducting layer is thus obtained, while at the same time it is avoided that a luminescent layer, if present, is damaged when the internal conductor is provided.

An attractive embodiment is characterized in that the contact member has a great cross-sectional dimension compared with the internal conductor. This also contributes to a good connection between the conducting layer and the internal conductor. The contact member may be integral with the internal conductor. In an embodiment, the contact member is a separate component. In this embodiment, the internal conductor may be fastened to the contact member, if necessary, after the conducting layer has been provided, so that the internal conductor does not hamper the access to the discharge space of any tools used for applying the conducting layer.

In an embodiment of the lighting unit according to the invention, the supply is accommodated in a holder fastened to the discharge vessel. The holder may also support a lamp cap.

Alternatively, the supply may be accommodated in a separate housing, the electrodeless lamp being connected to the supply via a cable. The invention accordingly also relates to an electrodeless lamp for use in the lighting unit.

The invention further relates to a discharge vessel for use in a lighting unit according to the invention. The discharge vessel according to the invention may be detachably coupled to the holder. If so desired, it may then be replaced with a different discharge vessel, for example, a discharge vessel provided with a luminescent layer which luminesces at a different color temperature. The holder may have, for example, a clamping contact member which cooperates with the metal tube.

BRIEF DESCRIPTION OF THE DRAWINGS

These and other aspects of the invention will be explained in more detail with reference to the accompanying drawing, in which.

DESCRIPTION OF THE PREFERRED EMBODIMENTS

Figure 1:
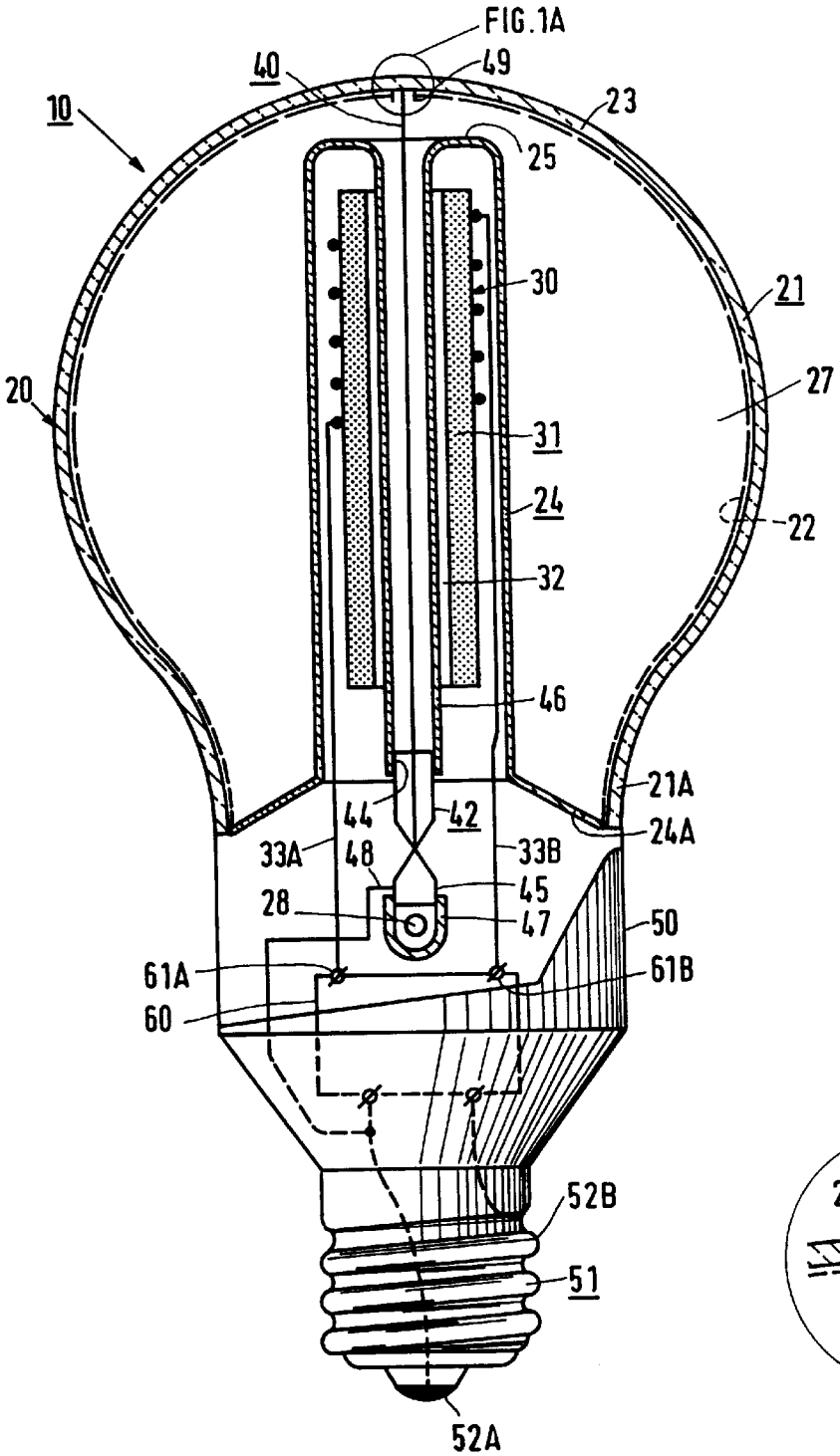
FIG. 1 shows the accompanying first embodiment of the lighting unit according to the invention in longitudinal sectional view.

An embodiment of the lamp according to the invention is shown in FIG. 1.

The lighting unit shown in FIG. 1 comprises an electrodeless low-pressure discharge lamp 10 which is provided with a radiation-transmitting discharge vessel 20 having a pear-shaped enveloping portion 21 and a tubular recessed portion 24 which is fastened to an end portion 21A of the enveloping portion 21 via a tapering flange 24A. The two portions 21, 24 are made of lime glass. The discharge vessel 20 encloses a discharge space 27 in a gastight manner and contains an ionizable filling, in this case a filling of mercury and argon. Alternatively, the filling may comprise a different metal capable of evaporation, for example, sodium, or the discharge vessel 20 may be filled, for example, exclusively with one or several rare gases. The lamp 10 is in addition provided with a coil 30 for generating a high-frequency magnetic field so as to maintain an electric discharge in the discharge space 27. The coil 30 is provided around a hollow core 31 of a soft magnetic material which is arranged in the recessed portion 24. In an alternative embodiment, the coil is provided around a synthetic resin tube.

The surface of the enveloping portion 21 facing the discharge space 27 is provided with a conducting layer 22 (shown in broken lines), here made of fluorine-doped tin oxide. Another suitable material for this is tin-doped indium oxide. In the present embodiment, the discharge vessel 20 supports a luminescent layer (not shown) on the conducting layer 22 so as to convert UV radiation generated in the discharge space into visible radiation.

Figure 1A:
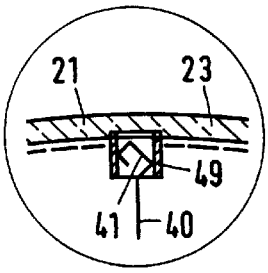
FIG. 1A shows a detail from FIG. 1.

The discharge vessel 20 has a tubular projection where a lead-through member 42, connected to the radiation-transmitting, electrically conducting layer 22 via an internal conductor 40, issues to the exterior of the discharge vessel. The internal conductor 40 here is a wire of a CrNiFe alloy, in this case 6% Cr, 42% Ni, and 52% Fe by weight. The wire forming the internal conductor 40 is connected to the radiation-transmitting, electrically conducting layer 22 by means of a contact member 49 formed by a bush having a great cross-sectional dimension compared with the elongate conductor 40 (See FIG. 1A). The wire 40 here has a resilient end 41 which is enclosed in the metal bush 49 with a clamping fit. The bush 49 is fused in the wall 23 of the enveloping portion 21. The lead-through member 42 is a metal tube made of the same alloy here as the metal wire 40. The metal tube 42 forms part of the tubular projection 46, 42, 47. A first, open end 44 of the metal tube 42 is fastened to the discharge vessel 20 by means of a glass tube 46, here made of lime glass, which issues into the discharge space 27 at the free end 25 of the recessed portion 24. Alternatively, the metal tube may be directly fastened to the discharge vessel, for example to the tapering flange of the recessed portion. In yet another embodiment, the metal tube is fastened to the conical zone of the enveloping portion of the discharge vessel, while the conducting layer extends over the metal tube. An internal conductor is unnecessary in that case.

In the embodiment shown, the metal tube 42 is provided with a seal 47 at a second end 45 opposed to the first end 44, which seal is obtained in that a further lime-glass tube fastened to the second end 45 is closed by fusion at its free end. The first lime-glass tube 46, the metal tube 42, and the glass seal 47 together form a tubular projection 46, 42, 47 which extends through the cavity 32 of the core 31 of the coil 30, concentrically with the recessed portion 24. The glass seal 47 surrounds a space in which an amalgam 28 of mercury with a bismuth-indium alloy is accommodated.

In the lighting unit shown in FIG. 1, a holder 50 containing a supply 60 for the lamp 10 is fastened to the discharge vessel 20. The supply 60 is connected to contacts 52A, 52B of a lamp cap 51 attached to the holder 50. The coil 30 is connected to output terminals 61A, 61B of the supply 60 via electrical conductors 33A, 33B. An external conductor 48 (i.e. external to the discharge space) connects one of the contacts 52A to the lead-through member 42, so that the radiation-transmitting, electrically conducting layer 22 is connected to a pole of the power mains during operation.

The discharge vessel of the lighting unit may be manufactured as follows. The contact member is fused into the enveloping portion of the discharge vessel, after which the inner surface of the enveloping portion is provided with a radiation-transmitting, electrically conducting layer. The conducting layer is provided, for example, in that a solution of indium chloride and a small quantity of tin chloride in butyl acetate is applied to the inner surface of the discharge vessel. The layer then covers not only the inner surface of the enveloping portion but also the end portion of the wire, so that an electrical connection between the contact member and the conducting layer is effected. The wire forming the internal conductor may be inserted with its resilient end into the contact member, whereby it is clamped tight. The recessed portion with the tubular projection may be manufactured simultaneously, the glass tube and the further glass tube being fused to the metal tube, and the tubular projection thus obtained is fused to the recessed portion. The recessed portion of the discharge vessel may then be placed against the enveloping portion, whereupon the internal conductor is guided through the tubular projection. Subsequently, the recessed portion may be fused to the enveloping portion, and the discharge vessel may be cleaned through the tubular projection and provided with an argon filling. The seal at the second end of the metal tube may then be formed from the further glass tube, and the internal conductor may be connected to the metal tube, for example, in that the latter is locally pinched, sufficient space remaining within the tube for admitting of a transport of mercury vapor between the amalgam and the discharge space.

We claim:

1. A lighting unit comprising: an electrodeless low-pressure discharge lamp, an electric supply for said lamp, wherein the lamp includes a discharge vessel having a radiation-transmitting enveloping portion and a recessed portion in which the discharge vessel surrounds a discharge space in a gastight manner and contains an ionizable filling, a coil arranged in the recessed portion for generating a high-frequency magnetic field so as to maintain an electric discharge in the discharge space, the enveloping portion of the discharge vessel including a radiation-transmitting, electrically conducting layer on a surface facing the discharge space, the discharge vessel having a tubular projecting portion located where a lead-through member, connected to the electrically conducting layer, issues to the exterior of the discharge vessel, the lead-through member having an opened end fastened to the tubular projecting portion of the discharge vessel wherein the lead-through member comprises a metal tube which constitutes at least a portion of the tubular projecting portion.

2. A lighting unit as claimed in claim 1, wherein the metal tube is provided with a glass seal.

3. A lighting unit as claimed in claim 2, wherein the glass seal surrounds a space which includes an amalgam.

4. A lighting unit as claimed in claim 1, wherein the radiation-transmitting, electrically conducting layer is connected to the metal tube via a contact member at one end of an internal conductor, the contact member being fixed by fusion in the enveloping portion.

5. A lighting unit as claimed in claim 4, wherein the contact member has a large cross-sectional dimension compared with the internal conductor.

6. An electrodeless low-pressure discharge lamp comprising:

a discharge vessel having an outer wall with a radiation-transmitting electrically conductive layer on an inner surface thereof and having a recessed inner wall, said discharge vessel being sealed in a gastight manner so as to define a discharge space containing an ionizable fill substance, means disposed in the vicinity of the recessed inner wall for generating a high frequency electric field so as to produce an electric discharge within said discharge space, wherein the discharge vessel further comprises a tubular projecting portion which couples the discharge space to the exterior of the discharge vessel, said tubular projecting portion comprising a lead-through member including a metal tube having an open end fastened to the tubular projecting portion which issues to the exterior of the discharge vessel, an internal conductor connected to the metal tube and to the electrically conductive layer, and an external conductor connected to the metal tube and to a terminal of the discharge lamp for connection to a supply wire of an AC mains.

7. An electrodeless low-pressure discharge lamp as claimed in claim 6 wherein the internal conductor is connected to the electrically conductive layer via a metal bushing secured to the inner wall of the discharge vessel and in contact with the electrically conductive layer.

8. An electrodeless low-pressure discharge lamp as claimed in claim 6 wherein the tubular projecting portion further comprises a glass tube extending within the discharge vessel with one end located in the vicinity of the area where the internal conductor is connected to the electrically conductive layer and its other end coupled to the metal tube, and wherein the metal tube is in alignment with the glass tube.

9. An electrodeless low-pressure discharge lamp as claimed in claim 6 wherein the tubular projecting portion further comprises a glass tube extending within the discharge vessel, and the metal tube has the open end fastened within one end of the glass tube and a second end which is closed by means of a glass seal.

10. An electrodeless low-pressure discharge lamp as claimed in claim 6 wherein the internal conductor is connected to the electrically conductive layer via a metal contact member secured to the inner wall of the discharge vessel and in contact with the electrically conductive layer and connected to one end of the internal conductor.

11. An electrodeless low-pressure discharge lamp as claimed in claim 6 wherein the tubular projecting portion further comprises a glass tube extending within the discharge vessel and said means for generating a high frequency field comprises a wire coil surrounding at least a part of said glass tube, and said internal conductor is connected to an interior wall of the metal tube.

12. An electrodeless low-pressure discharge lamp as claimed in claim 6 wherein said internal conductor is connected to an interior wall of the metal tube and said external conductor is connected to an outside wall of the metal tube.

13. An electrodeless low-pressure discharge lamp as claimed in claim 6 wherein the discharge vessel has a glass wall and the temperature coefficient of expansion of the metal tube corresponds to that of the glass wall of the discharge vessel.

14. An electrodeless low-pressure discharge lamp comprising:

a discharge vessel having an outer wall with a radiation-transmitting electrically conductive layer on an inner surface thereof and having a recessed inner wall, said discharge vessel being sealed in a gastight manner so as to define a discharge space containing an ionizable fill substance, means disposed within the outer wall of the discharge vessel for generating a high frequency electric field so as to produce an electric discharge within said discharge space, wherein the discharge vessel further comprises a tubular projecting portion which couples the discharge space to the exterior of the discharge vessel, a lead-through member including a metal tube having an open end fastened to said tubular projecting portion and which is electrically connected to the electrically conductive layer, and an external conductor connected to the metal tube and to a terminal of the discharge lamp for connection to a supply wire of an AC supply.

15. An electrodeless low-pressure discharge lamp as claimed in claim 14 wherein the metal tube is fixed to the discharge vessel so as to seal said discharge vessel in a gastight manner.

16. An electrodeless low-pressure discharge lamp as claimed in claim 14 wherein said metal tube is electrically connected to the electrically conductive layer via an internal wire shaped conductor connected to the electrically conductive layer and to an interior wall of the metal tube.

17. The lighting unit as claimed in claim 1 further comprising an internal conductor connecting an interior wall of the metal tube to the electrically conducting layer of the enveloping portion of the discharge vessel.

18. The lighting unit as claimed in claim 1 wherein the metal tube is sealed so as to close the discharge vessel in a gastight manner.

19. An electrodeless low-pressure discharge lamp as claimed in claim 14 wherein the tubular projecting portion has a first end proximate to the area of the electrically conductive layer which is electrically connected to the metal tube and the metal tube is located at a second end of said tubular projecting portion remote from said first end thereof.

20. An electrodeless low-pressure discharge lamp as claimed in claim 14 wherein the electrical connection of the metal tube to the electrically conductive layer comprises, within said metal tube, an internal wire conductor connected to the electrically conductive layer, and wherein the metal tube issues to the exterior of the discharge vessel.

* * * * *